US008770238B2

(12) United States Patent
Graffin

(10) Patent No.: US 8,770,238 B2
(45) Date of Patent: Jul. 8, 2014

(54) SUSPENDED DELIVERY DEVICE AND A CONTAINER-FILLER INSTALLATION INCLUDING SUCH DEVICES

(75) Inventor: Jean-Jacques Graffin, Winfield, IL (US)

(73) Assignee: Serac Group, La Ferte Bernard (FR)

( * ) Notice: Subject to any disclaimer, the term of this patent is extended or adjusted under 35 U.S.C. 154(b) by 1010 days.

(21) Appl. No.: 12/813,284

(22) Filed: Jun. 10, 2010

(65) Prior Publication Data

US 2011/0108161 A1 May 12, 2011

(30) Foreign Application Priority Data

Jun. 11, 2009 (FR) ..... 09 02831

(51) Int. Cl.
*B65B 3/28* (2006.01)
*B67C 3/20* (2006.01)
*B67C 3/24* (2006.01)

(52) U.S. Cl.
CPC ..... *B67C 3/202* (2013.01); *B67C 3/242* (2013.01); *B65B 3/28* (2013.01)
USPC ..... 141/83; 141/372; 177/59; 177/60; 177/118; 222/77

(58) Field of Classification Search
CPC ..... B67C 3/202; B67C 2/242; B65B 3/28
USPC ..... 141/83, 94, 372; 177/59, 60, 89, 177/116–123; 222/55, 58, 77
See application file for complete search history.

(56) References Cited

U.S. PATENT DOCUMENTS

| | | | | |
|---|---|---|---|---|
| 2,605,075 | A * | 7/1952 | Brown | 177/78 |
| 4,832,092 | A * | 5/1989 | Hirose et al. | 141/1 |
| 5,301,725 | A * | 4/1994 | Meinzinger | 141/372 |
| 6,073,667 | A * | 6/2000 | Graffin | 141/372 |
| 6,220,312 | B1 * | 4/2001 | Hirsch et al. | 141/83 |
| 6,399,901 | B1 * | 6/2002 | Nishino et al. | 177/52 |
| 6,655,421 | B2 * | 12/2003 | Kohashi et al. | 141/83 |
| 6,667,444 | B1 * | 12/2003 | Armitage | 177/168 |
| 6,688,341 | B1 * | 2/2004 | Meunier et al. | 141/83 |
| 7,278,451 | B2 * | 10/2007 | Cavallari | 141/83 |
| 7,410,623 | B2 * | 8/2008 | Mehus et al. | 422/255 |
| 7,896,198 | B2 * | 3/2011 | Mehus et al. | 222/77 |
| 7,913,720 | B2 * | 3/2011 | Tribble et al. | 141/27 |
| 8,151,544 | B2 * | 4/2012 | Till et al. | 53/77 |
| 8,245,738 | B2 * | 8/2012 | Neumayer | 141/83 |

(Continued)

FOREIGN PATENT DOCUMENTS

| | | | |
|---|---|---|---|
| DE | 20 2004 020362 | | 5/2005 |
| DE | 10 2006 017706 | | 10/2007 |
| DE | 10 2007 014 639 | | 9/2008 |
| DE | 102009011949 | * | 7/2010 |

*Primary Examiner* — Timothy L Maust
*Assistant Examiner* — Robert Bell, III
(74) *Attorney, Agent, or Firm* — Muncy, Geissler, Olds & Lowe, P.C.

(57) ABSTRACT

A delivery device for delivering composition in a container filler installation, the device comprising a tube having at least an end provided with a nozzle and an opposite end provided with means for fastening to a feed line of the filler installation, and the device further including a plate fastened to the tube and provided with a support having a portion extending in register with the nozzle to support a container. The invention also provides a filler installation including at least one such device.

8 Claims, 3 Drawing Sheets

(56) References Cited

U.S. PATENT DOCUMENTS

| | | | | |
|---|---|---|---|---|
| 8,256,473 | B2 * | 9/2012 | Zanini et al. | 141/82 |
| 8,277,745 | B2 * | 10/2012 | Mehus et al. | 422/264 |
| 8,288,668 | B2 * | 10/2012 | Zanini et al. | 177/54 |
| 8,424,575 | B2 * | 4/2013 | Neumayer | 141/284 |
| 2008/0223477 | A1 * | 9/2008 | Stocchi | 141/1 |
| 2009/0095370 | A1 * | 4/2009 | Krulitsch | 141/6 |
| 2012/0060973 | A1 * | 3/2012 | Jaeger et al. | 141/83 |
| 2012/0073883 | A1 * | 3/2012 | Sobiech | 177/118 |

* cited by examiner 3
4
5
10
7
5
16
2
1

SUSPENDED DELIVERY DEVICE AND A CONTAINER-FILLER INSTALLATION INCLUDING SUCH DEVICES

FIELD OF THE INVENTION

The present invention relates to a composition delivery device for a container-filler installation. The invention also provides a filler installation including such devices.

BACKGROUND OF THE INVENTION

A filler installation generally comprises a stand having a rotary platform mounted thereon and surmounted by a composition feed assembly having one or more feed lines. The feed lines have ends that are connected to composition delivery devices, each delivery device including a tube having at least an end provided with means for fastening it to the feed line and an opposite end provided with a nozzle. The device further includes a measuring valve associated with control means. The control means include measuring members, e.g. weighing members or constant level members, enabling the quantity of composition to be measured. Container supports are secured to the platform in order to support the containers in register with the filler nozzles.

OBJECT AND SUMMARY OF THE INVENTION

An object of the invention is to provide means for making such installations more versatile by making them easier to modify, in particular concerning how they measure out composition or how they support containers.

To this end, the invention provides a delivery device for delivering a composition in an installation for filling containers, the device comprising a tube having at least an end provided with a nozzle and an opposite end provided with means for fastening it to a line for feeding the filler installation, the device also comprising a plate fastened to the tube and provided with a support having a portion that extends in register with the nozzle to support a container, the device having at least one measuring valve and control means extending outside the tube and including a weighing member, the control means being received in a housing that is secured to the tube.

Thus, the container of the support is suspended from the tube, which is itself suspended from the feed line. Fastening the delivery device thus enables the support to be fastened. No action is required on the platform. The delivery device incorporates the control means that are fastened to the tube. Suspending the delivery device from the feed line also makes it possible to fasten the control means thereto as well as the support. The housing serves to protect the control means against external attack and in particular against splashes of liquid, dust, or impacts while the delivery device is being put into place or removed. Advantageously, the support includes resilient means for retaining containers that do not require positive control, or electrical holder means that can be controlled with no more than an electrical power supply.

The invention also provides a filler installation including a composition feed line having at least one delivery device suspended therefrom and presenting any one of the above characteristics.

The invention thus presents a structure that is simple, as a result of suspending the support from the feed line of the installation.

Other characteristics and advantages of the invention appear on reading the following description of a particular, non-limiting embodiment of the invention.

BRIEF DESCRIPTION OF THE DRAWINGS

Reference is made to the accompanying drawings, in which.

MORE DETAILED DESCRIPTION

Figure 1:
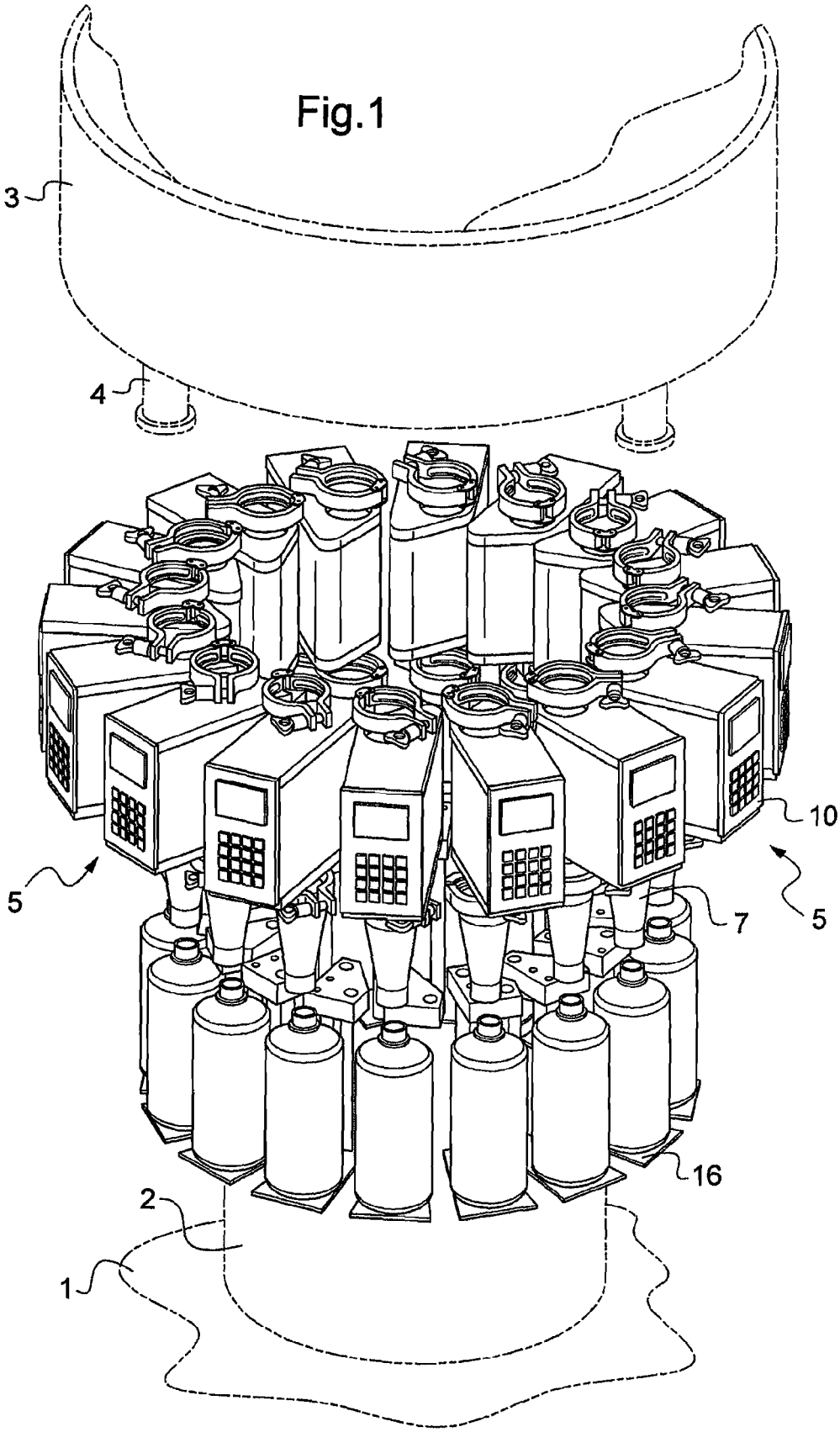
FIG. 1 is a fragmentary perspective view of a filler installation in accordance with the invention.

With reference to FIG. 1, the filler installation in accordance with the invention described herein is for installing in a line for packaging containers, such as bottles, each container comprising a body with a bottom and at its opposite end a top portion provided with a neck having a collar.

The filler installation comprises a stand 1 having a rotary structure 2 mounted thereon (drawn in chain-dotted lines) provided in its top portion with a feed line (also drawn in chain-dotted lines), here comprising a tank 3 of composition from which feed channels 4 extend (only a few being shown).

The filler installation has composition delivery devices, given overall reference 5, which are suspended from the feed pipes 4.

Figure 2:
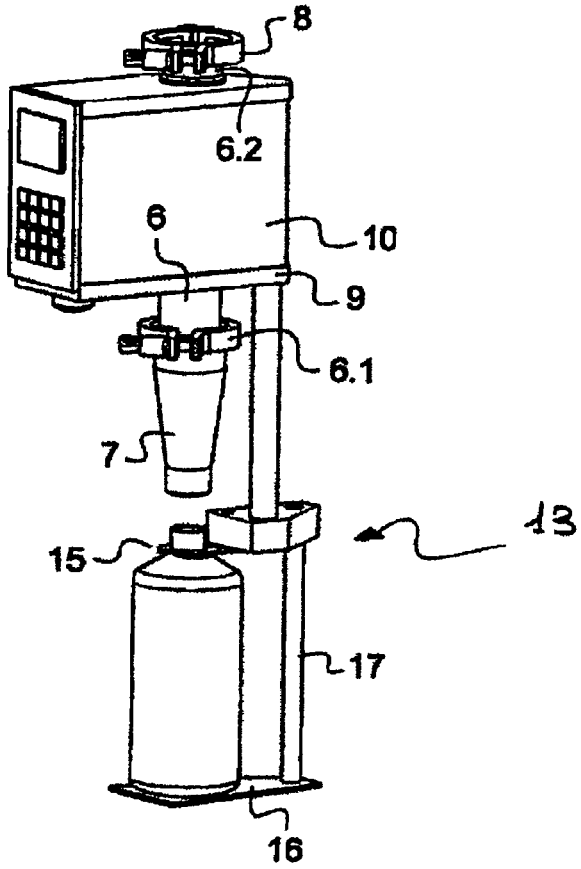
FIG. 2 is a perspective view of a delivery device in accordance with a first embodiment.
Figure 3:
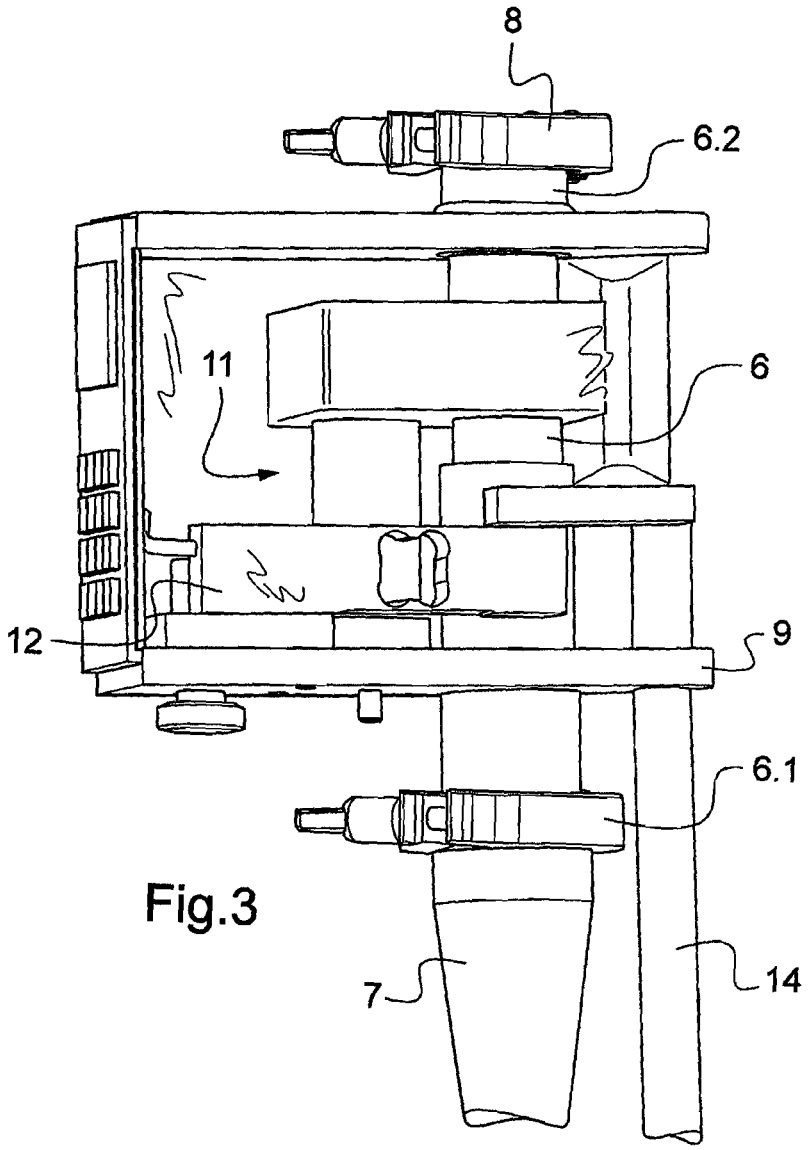
FIG. 3 is a detailed view, shown partially in transparency, of the top portion of the delivery device.

In the embodiment shown in FIGS. 1 to 3, each delivery device 5 comprises a tube 6 having at least an end 6.1 with a nozzle 7 and an opposite end 6.2 provided with means for fastening it to the feed pipe 4.

The fastener means comprise a collar projecting laterally from the second end 6.2 and designed to be received inside a clamp 8 together with a collar at the free end of the feed pipe 4.

Each delivery device comprises a plate 9 fastened to the tube 6 and forming a bottom horizontal wall of a housing 10 secured to the tube 6. The housing 10 contains control means 11 for controlling a valve (not shown in the figures) that extends within the tube 6. In this example, the control means 11 comprise an electromagnetic member for moving the valve and connected to a weighing member so as to be controlled as a function of signals issued by the weighing member. The weighing member comprises, in conventional manner, a deformable bar 12 fastened inside the housing 10, being cantilevered over the plate 9. In order to operate, the control means 11 need to be connected to a source of electricity that is not shown. The control means 11 and the deformable bar 12 are protected from external attack by the housing 10.

The deformable bar 12 has a free end with a container support given overall reference 13 connected thereto.

The support 13 comprises a vertical column 14 that is suspended from the free end of the deformable bar 12 and that possesses a bottom end that is rigidly secured to a support portion 15 supporting the container by its neck and a support portion 16 supporting the bottom of the container. The column 14 passes through the plate 9 via an opening in which the column 14 is received to slide vertically. The support portion 15 comprises two jaws that are movable between an open position and a closed position towards which the jaws are urged resiliently. When the neck is engaged between the jaws, they move apart to allow the neck to pass through prior to resiliently reclosing thereon, with the collar then resting on the top surfaces of the jaws. The support portion 16 is connected to the support portion 15 by a vertical column 17 suspended from the support portion 15.

Naturally, the invention is not limited to the embodiments described but covers any variant using equivalent means and coming within the ambit of the invention as defined by the claims.

In particular, the invention is usable in filler installations that may be rotary or linear, with any type of measuring-out means, in particular weighing means or constant level means.

The nozzle may be removable as described above, or it may be formed integrally with the tube, and the tube may be very short, or on the contrary it may be quite long.

The valve may be provided in the tube or in the nozzle.

The control means may be located in part inside the tube.

The weighing means may be of some other type.

The number of delivery devices in a filler installation may be other than that shown. The filler installation may thus include only one delivery device.

What is claimed is:

1. A delivery device for delivering a composition in an installation for filling containers, the device comprising a tube having at least an end provided with a nozzle and an opposite end provided with means for fastening it to a line for feeding the filler installation, the device also comprising a plate fastened to the tube and provided with a support having a portion that extends in register with the nozzle to support a container, the device having at least one measuring valve and control means extending outside the tube and including a weighing member, the control means being received in a housing that is secured to the tube and fastened to the tube, the housing extending around a portion of the tube.

2. A device according to claim 1, wherein the weighing member comprises a deformable bar mounted between the plate and the support.

3. A device according to claim 2, wherein the deformable bar extends inside the housing, and the plate forms a horizontal wall of the housing.

4. A device according to claim 3, wherein the support comprises a column that is suspended from one end of the deformable bar and that possesses a bottom end having the portion of the support that supports the container secured thereto.

5. A device according to claim 4, wherein the portion of the support is arranged to hold the container via a top portion thereof.

6. A device according to claim 1, wherein the support comprises a first support portion arranged to hold the container via a top portion thereof and a second support portion arranged to support a bottom of the container.

7. A filler installation including a feed line for feeding it with composition and having suspended therefrom at least one delivery device according to claim 1.

8. A delivery device for delivering a composition in an installation for filling containers, the device comprising a tube having at least an end provided with a nozzle and an opposite end provided with means for fastening it to a line for feeding the filler installation, the device also comprising a plate directly fastened to the tube and provided with a support having a portion that extends in register with the nozzle to support a container, the device having at least one measuring valve and control means extending outside the tube and including a weighing member, the control means being received in a housing that is secured to the tube.

* * * * *